United States Patent [19]

Friedman et al.

[11] 4,060,854

[45] Dec. 6, 1977

[54] BELT AND BUCKLE ASSEMBLY

[75] Inventors: Harvey William Friedman, Longmeadow; Donald Wyman Corey, Wilbraham, both of Mass.

[73] Assignee: Buxton, Incorporated, Agawam, Mass.

[21] Appl. No.: 762,198

[22] Filed: Jan. 24, 1977

Related U.S. Application Data

[63] Continuation of Ser. No. 661,603, Feb. 26, 1976, abandoned.

[51] Int. Cl.[2] ..... A41F 3/02

[52] U.S. Cl. ..... 2/338

[58] Field of Search ..... 24/163 KO, 90 A, 49 A, 24/182, 183; 2/300, 311, 312, 321–325, 319, 338; 40/21 C

[56] References Cited

U.S. PATENT DOCUMENTS

| | | | |
|---|---|---|---|
| 1,559,291 | 10/1925 | Simmons | 24/182 X |
| 2,718,043 | 9/1955 | Wallace | 24/182 X |

*Primary Examiner*—Doris L. Troutman

*Attorney, Agent, or Firm*—Richard A. Wise; Oistein J. Bratlie; Scott R. Foster

[57] ABSTRACT

A belt and buckle assembly in which first and second ends of a belt are adapted to be interconnected and the belt has means for receiving and releasably retaining a buckle member; and a plurality of buckle members, each having means for attachment to the belt, such that one of a plurality of available buckles may be selectively attached to the belt and subsequently removed and replaced by a second of the buckles.

1 Claim, 3 Drawing Figures

BELT AND BUCKLE ASSEMBLY

This is a continuation of application Ser. No. 661,603, filed Feb. 26, 1976, now abandoned.

BACKGROUND OF THE INVENTION

1. Field of the Invention

This invention relates to articles of clothing and is directed more particularly to a belt buckle assembly.

2. Description of the Prior Art

In common use today are belts having a buckle permanently attached to one end thereof and a series of holes at the other end thereof. The buckle is adapted to interconnect with a selected one of the series of holes to facilitate interconnection of the two ends of the belt.

If a belt buckle is desired to be changed, such is generally accomplished by changing belts. Inasmuch as a substantial portion of the cost of a belt and buckle assembly resides in the belt portion, the discarding of the entire assembly to effect a change in the buckle is not economically feasible.

In some embodiments, a belt end may be manually taken apart, or "undone" so that a buckle can be withdrawn and another substituted for it. The mechanics of the replacement of buckles are not always apparent and the execution thereof is often time consuming and aggravating.

SUMMARY OF THE INVENTION

It is therefore an object of the invention to provide a belt and buckle assembly in which the buckle is not part of the interconnection means of the assembly and may be readily removed and replaced, even while the belt is being worn, without "undoing" or disconnecting the belt ends.

A further object of the invention is to provide such an assembly in which a single belt is adapted to releasably retain any of a plurality of buckles, each of which may be of a distinctive design suitable for various occasions.

With the above and other objects in view, as will hereinafter appear, a feature of the present invention is the provision of a belt and buckle assembly comprising a belt member having first and second ends, each end having means for interconnection so that the ends may be connected together, a first of the interconnection means on the first end having a plurality of engagement means each being adapted for connection to a second of the interconnection means on the second end of the belt member, such that the second interconnection means may be selectively connected to any one of the engagement means, the second end of the belt member being further provided with first attachment means for receiving and releasably retaining a buckle member, and buckle means comprising a plurality of buckle members, each buckle member being provided with second attachment means adapted to cooperate with the first attachment means to releasably attach a first of the buckle members to the belt, the first and second attachment means permitting the first buckle member to be readily removed from the belt member and a second of the buckle members to be attached to the belt member in place of the first buckle member.

The above and other features of the invention, including various novel details of construction and combinations of parts, will now be more particularly described with reference to the accompanying drawing and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent.

DESCRIPTION OF THE PREFERRED EMBODIMENT

Figure 1:
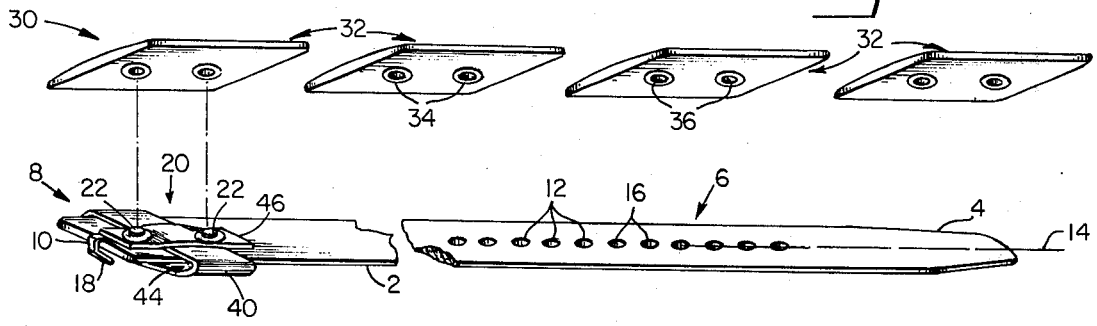
FIG. 1 is a perspective view of one form of belt and buckle assembly illustrative of an embodiment of the invention.
Figure 2:
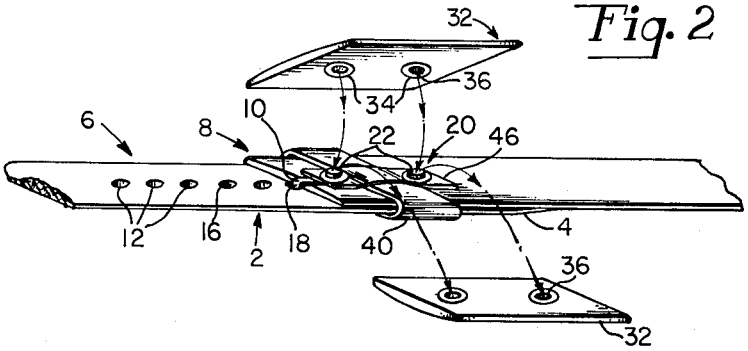
FIG. 2 is a perspective view of the assembly shown in FIG. 1, but shown in a different position.
Figure 3:
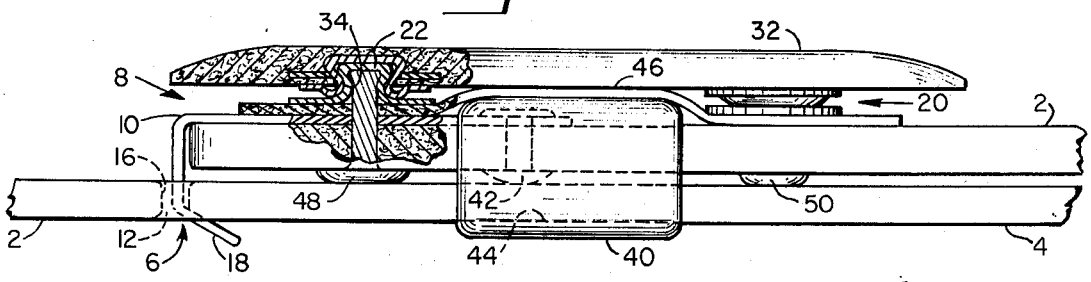
FIG. 3 is a top plan view, partly in section.

Referring to the drawing, it will be seen that the belt and buckle assembly of the present invention comprises a belt member 2, generally elongated and of a flexible material, usually leather, cloth or synthetic leather and/or cloth. The belt member 2 is provided with a first end 4 having first interconnecting means 6 and a second end 8 having second interconnecting means 10, such that the ends 4, 8 may be connected together as shown in FIGS. 2 and 3. The first interconnection means 6 of the first end 4 of the belt member 2 comprise a plurality of engagement means 12 disposed in a line extending parallel to a lengthwise center line 14 of the belt member. Each of the engagement means 12, which in the embodiment shown comprise holes 16, are adapted for interconnection with the second interconnecting means 10 on the second end 8 of the belt member 2. In the embodiment shown, the second interconnecting means 10 comprise hook means 18 which may be engaged with a selected hole 16 to connect the ends 4, 8 together.

The second end 8 of the belt member 2 is also provided with first attachment means 20 for receiving and releasably retaining buckle members. In the illustrative embodiment, the first attachment means 20 comprise projections 22 mounted on a surface of the belt member 2.

Buckle means 30 are provided comprising a plurality of buckles 32, each buckle 32 being provided with second attachment means 34 adapted to cooperate with the first attachment means 20 to releasably secure a buckle 32 to the belt member 2. In the illustrative embodiment, the second attachment means 34 comprise recesses 36 adapted to receive the projections 22 in a snap-lock manner (FIG. 3).

The second end 8 of the belt member 2 may be provided with a loop member 40 which serves to cover a rivet member 42 (FIG. 3) which secures the hook means 18 to the belt 2, but which more importantly provides an opening 44 through which the first end 4 of the belt 2 may be slid, the first end being retained by the loop member 40 after the two belt ends are connected together. The loop member 40 may be held in place by a strap member 46 which is anchored on either side of the loop member 40 by rivets 48, 50. In addition to anchoring the strap member 46, and thereby the loop member 40, the rivets 48, 50 provide the projections 22 which comprise the first attachment means 20 for receiving the buckle means 32. The rivet 48 may further provide additional anchoring means for the hook member 18, so that the hook member is securely fastened to the belt 2 by means of two rivets, 42 and 48. Thus, the rivet 48 serves to retain the hook member 18, serves to retain the strap member 46, and serves to provide attachment means 20 for receiving buckle means 32.

In operation, a buckle 32 is selected from the plurality of buckles available and snapped onto the belt member 2, the attachment means 20, 34 cooperatively securing the buckle 32 to the belt member 2. The belt member may then be placed about the operator, the first end of the belt being slid through the opening 44 and the hook means 18 being engaged with a selected hole 16 to secure together the two ends of the belt member. If it is then desired to change buckles, without otherwise disturbing the assembly, the operator removes the buckle 32 from the belt member 2 by an outward pulling motion. Another buckle member 32 is selected and snapped onto the belt member. Thus, a change of buckles (FIG. 2) is accomplished in a matter of seconds, and done simply and without undue manipulation of the belt assembly.

It is to be understood that the present invention is by no means limited to the particular construction herein disclosed and/or shown in the drawing, but also comprises any modifications or equivalents within the scope of the disclosure. For example, it will be apparent that the rivet 42 may be omitted from the illustrative construction.

Having thus described my invention what I claim as new and desire to secure by Letters Patent of the U.S. is:

1. Belt and buckle assembly comprising a belt member having means for interconnecting first and second ends thereof, a buckle member having first and second recesses therein, said belt member being further provided with first and second rivet means for engagement with said first and second recesses in said buckle member for receiving and releasably retaining said buckle member, said buckle member being distinct from said interconnecting means, said belt member second end being provided with a loop member mounted thereon and affording an opening for receiving said belt member first end, said loop member being held on said second end by way of a strap member affixed to said second end by said first rivet, said first rivet means further comprising means for retaining said interconnecting means on said second end of said belt member.

* * * * *